US007743535B2

(12) United States Patent
Goodman et al.

(10) Patent No.: US 7,743,535 B2
(45) Date of Patent: Jun. 29, 2010

(54) DETACHABLE LIFTING MECHANISM FOR A TRACKED SNOW VEHICLE METHOD AND APPARATUS

(76) Inventors: Ron Goodman, 602 W. Lake Samish, Bellingham, WA (US) 98229; Terry Goodman, 602 W. Lake Samish, Bellingham, WA (US) 98229

( * ) Notice: Subject to any disclaimer, the term of this patent is extended or adjusted under 35 U.S.C. 154(b) by 769 days.

(21) Appl. No.: 11/611,096

(22) Filed: Dec. 14, 2006

(65) Prior Publication Data

US 2007/0130806 A1 Jun. 14, 2007

Related U.S. Application Data

(60) Provisional application No. 60/750,817, filed on Dec. 14, 2005.

(51) Int. Cl.
*E01H 5/04* (2006.01)

(52) U.S. Cl. ..... 37/234

(58) Field of Classification Search ..... 37/196, 37/197, 219–236, 266, 268, 270–274; 172/298, 172/387, 393, 684.5, 701, 815, 832
See application file for complete search history.

(56) References Cited

U.S. PATENT DOCUMENTS

| | | | | | |
|---|---|---|---|---|---|
| 4,266,819 | A | | 5/1981 | Pemberton | |
| 4,273,500 | A | | 6/1981 | Yates | |
| 4,306,362 | A | * | 12/1981 | Waterman | 37/219 |
| 4,479,312 | A | * | 10/1984 | Turgeon | 37/219 |
| 4,763,742 | A | | 8/1988 | Langford | |
| 5,285,588 | A | * | 2/1994 | Niemela et al. | 37/234 |
| 6,425,196 | B1 | * | 7/2002 | Weagley et al. | 37/270 |
| 6,641,356 | B1 | | 11/2003 | Defrancq | |
| 6,698,112 | B2 | | 3/2004 | Grobler et al. | |

FOREIGN PATENT DOCUMENTS

| | | |
|---|---|---|
| WO | WO 82/04230 | 12/1982 |

* cited by examiner

*Primary Examiner*—Robert E Pezzuto
(74) *Attorney, Agent, or Firm*—Dwayne E. Rogge; Hughes Law Firm, PLLC

(57) ABSTRACT

A lifting device adapted to be fitted to a tracked vehicle which is configured to operate in snow-covered terrain. The lifting device has an interface member which in one form allows for an interface portion of the mast region to fit to a plurality of commercially available tracked snow vehicles. Further, in one form, the lifting device interfaces with the existing hydraulics of conventional tracked snow vehicles.

24 Claims, 17 Drawing Sheets

DETACHABLE LIFTING MECHANISM FOR A TRACKED SNOW VEHICLE METHOD AND APPARATUS

RELATED APPLICATIONS

This application claims priority benefit of U.S. Ser. No. 60/750,817, filed Dec. 14, 2005.

BACKGROUND OF THE INVENTION

Ski lifts and other operations in the snow often require repositioning of the snow to groom slopes or otherwise clearing of the snow when desirable (such as clearing Arctic runways for planes). Snow track-type vehicles are commonly available and sold to ski areas, oil drilling operations, or any other type of commercial operation where there is a large quantity of snow and mechanical work is required in that area. Snow track-type vehicles commonly have an actuating system with a plurality of hydraulic members that are utilized to reposition a base mount. Oftentimes, the base mount is adapted to have a blade attached thereto. In one form, the blade has winglets which are hydraulically actuated to rotate about a substantially vertical axis in the lateral distal portions of the blade. Normally, the winglets are utilized by the snow track-type vehicle operator to desirably reposition the snow. Of course a hydraulic line is in communication with the wing led actuators and control of this hydraulic line is within the cab of the unit.

It has been problematic in certain environments such as ski resorts to reposition large, heavy or cumbersome items. More particularly, ski resorts may host events such as snow parks where snowboarders require certain props for these events. Such props can include rails, drops, wooden based jumps, etc. which are commonly constructed from wood and metal and are quite heavy. The props are generally robust enough to handle the various impacts imparted thereon and further must have sufficient mass so as not to reposition when impacted.

In addition to the various uses noted above, chairlift maintenance is another concern, where lifting heavy chairs, which are now commonly removable from the main operating cable, can be a difficult task. Therefore, having a lifting mechanism with a sufficient range of height to lift the various chairs on and off is extremely useful. Further, in various snowfield areas such as ski slopes or oil fields, removing garbage and other material from, for example, eating quarters is extremely useful. On that note, having a forklift-like item that attaches to snowplowing units near, for example, oil pipeline fields is very advantageous for repositioning material and moving pipes and providing adequate mobility for positioning, for example, pipes for welding or other installation.

Therefore, a lifting device is adapted to fit to snow track-type vehicles to expand their functionality and allow a forklift-type of lifting apparatus on a snow field, providing various benefits. Further, interfacing with the existing hydraulics to have an ergonomic and human factor type engineering compliant system is useful to lower the time required in the training of snow track-type vehicle operators. Therefore, as described in detail below, there is a method and apparatus for providing such mechanical lifting in a snow field environment while utilizing existing equipment and controls.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

SUMMARY OF THE DISCLOSURE

Disclosed below is a lifting device adapted to be positioned onto a over snow track vehicle where a positioning member and a control member is provided that is adapted to control a plurality of hydraulic lines. One pair of the hydraulic lines being adapted to normally operate one or more winglets. The lifting device comprises an interface member having connection portions adapted to engage the positioning member in a fixedly and removably attached manner. Further a hydraulic lift system is provided having a hydraulic line that is in fluid communication with a hydraulic actuator. The actuator being operatively connected to a repositioning member that is adapted to reposition with respect to the interface member. A base mount is provided having an attachment region that is adapted to be rigidly and removably attached to the interface member. One of the hydraulic lines that is controlled by the control member which normally controls one or more winglets is in communication with the hydraulic actuator.

In one form a set of tines are positioned on the repositioning member. Further the lifting device is operatively configured to be positioned in a stored orientation where standing posts are operatively attached to lateral portions of the intermediate member. In this form the storage posts are adapted to be positioned on the intermediate member. Because there are various manufacturers of over-snow tracked vehicles, a second intermediate member can be provided to attach the base mount to a different design of over-snow track vehicle.

In another form the actuating system has first and second actuating lines for the actuator which is controlled by first and second hydraulic lines from the over-snow track vehicle designed to control a single winglet. Another piston on the lift mechanism is referred to as the carriage actuator of the hydraulic lift system and is controlled by third and fourth winglet lines of the over-snow tracked vehicle.

In one embodiment the carriage actuator operates a side shift mechanism operatively configured to reposition the tines in a lateral direction. In another embodiment where the carriage actuator operates a push-pull assembly operatively configured to reposition the tines in a forward and rearward direction.

Also taught herein is a method of interfacing a snow forklift device with a snow tracked vehicle. The method comprises attaching a repositioning member to a base mount in a manner where the repositioning member is adapted to be forcefully moved from a first lower position to a second upper position. The method then allows for providing an attachment region of the base mount having a uniform attachment interface. Thereafter an installer attaches the uniform attachment interface to an intermediate member which has a receiving uniform attachment portion and a customized attachment portion where the custom attachment portion is adapted to be retrofitted to the tract vehicle. Another step in the method includes attaching winglet hydraulic lines to a main actuator that is adapted to forcefully move the repositioning member from the first lower position to the second upper position. Of course these steps can occur in various other orders of execution.

The method can provide for stand posts that are operatively configured to be positioned in a stored position securely attached to the intermediate member and whereby when the stand posts are positioned in the stored position a portion of the stand posts extend laterally from the repositioning member to protect a cab region from a load positioned on tines attached to the repositioning member.

The embodiments herein further describe a lifting device for an over-snow track vehicle which operates with an over-snow track vehicle having a base mount, the base mount being driven by an over-snow track vehicle actuating system having first and second winglet lines. The lifting device in this form comprises an interface portion comprising a mounting plate having a lifting device mounting region and a base mount attachment region. The base mount attachment region being operatively configured to be fixedly and removably attached to the base mount of the over-snow track vehicle. Further provided is a mast region operatively configured to be fixedly and removably attached to the lifting device mounting region of the mounting plate. A carriage is movably attached to a mast region, the carriage being operatively configured to be repositionable with respect to the mounting plate. Further provided is a hydraulic system comprising a drive actuator with first and second inlet ports, the inlet ports being operatively configured to be connected to first and second winglet lines of the over-snow track vehicle.

In one form the first and second winglet lines of the over-snow track vehicle are controlled by a controller that normally controls a single winglet. In addition third and fourth winglet lines of the over-snow track vehicle are connected to the lift mechanism and control a hydraulic member attached to the carriage. It should be noted that the interface portion in one form is operatively configured to be detached from the base mount of the over-snow track vehicle and be positioned on first and second stand posts. The stand posts are operatively configured to be positioned within mounting receptacles at first and second lateral regions of the interface portion, and the stand posts have a stored orientation where a portion of the stand post extends beyond the first and second lateral portions of the interface member.

To have the lifting device be versatile to attach to multiple different over-snow tracked vehicles, the interface portion is operatively configured for a particular base mount of the over-snow track vehicle and a second interface member can be replaced to attach the mast region to a different type of over-snow track vehicle. Other features of the various examples are shown herein.

DESCRIPTION OF THE PREFERRED EMBODIMENTS

In general, the first drawings with reference to FIGS. 1-10 show various existing vehicles and structures relating thereto that are common in environments with large amounts of snow such as ski resorts, oil rig camps in the Arctic or in Alaska, etc.

Figure 2:
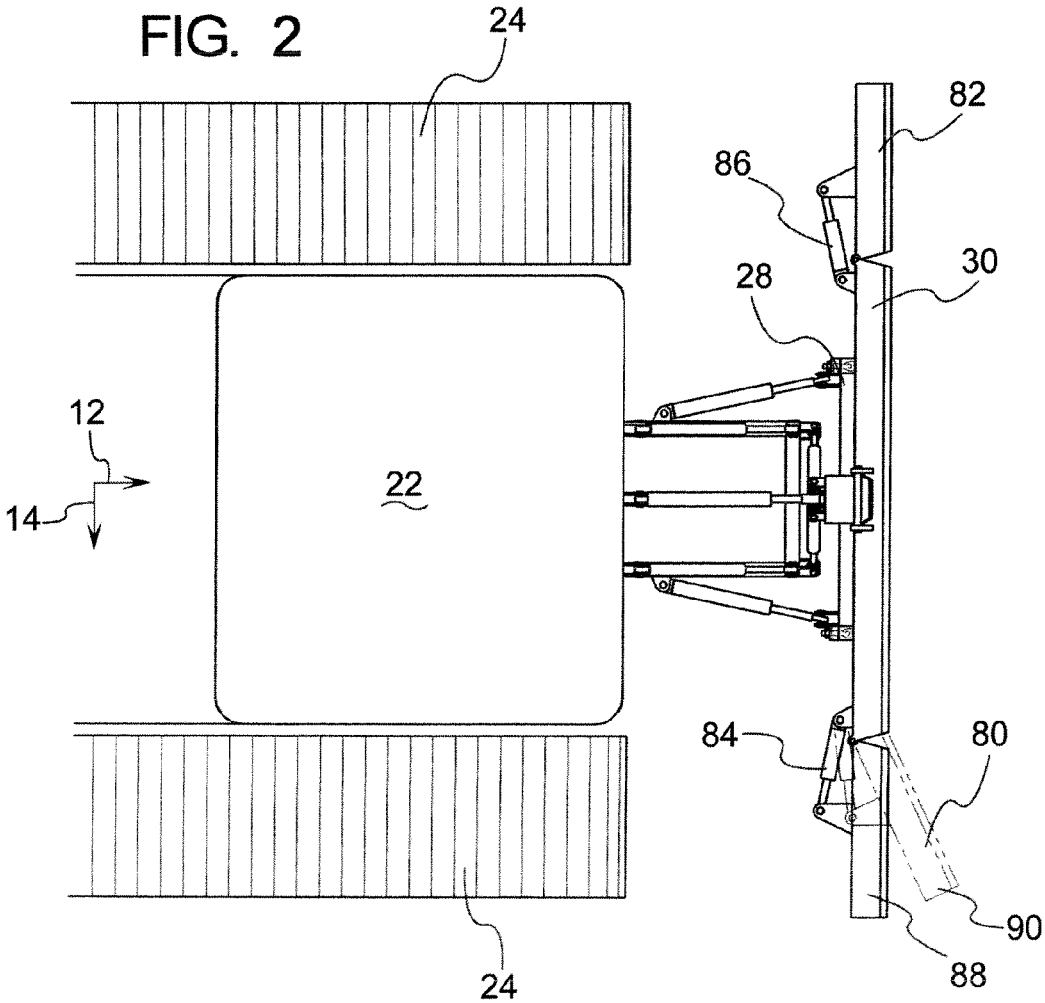
FIG. 2 shows a top view schematically indicating the snow track-type vehicle and the actuating system illustrating motion of the winglets in the lower right-hand portion of this figure.
Figure 3:
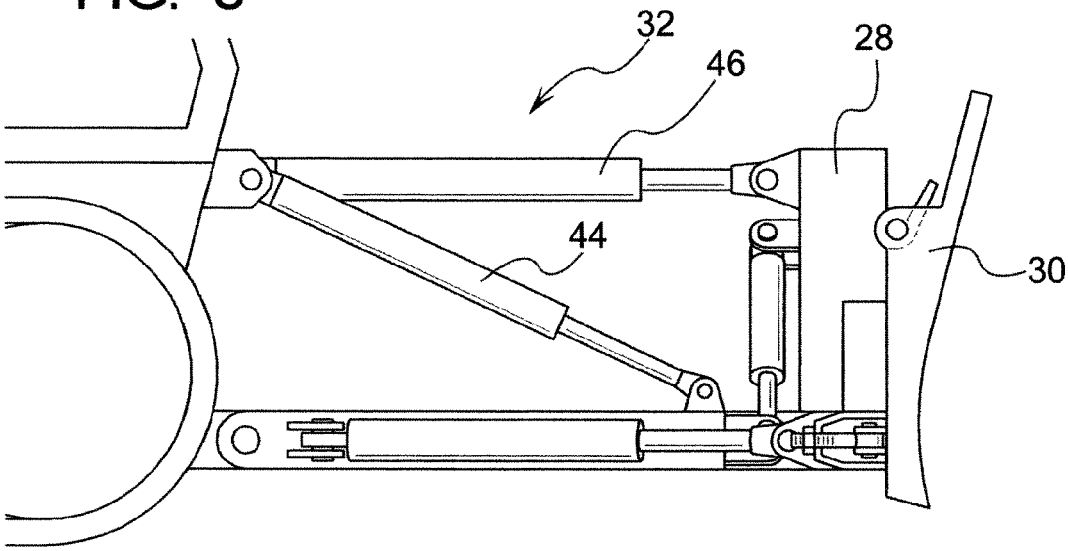
FIG. 3 shows a side view of the actuating system.
Figure 4:
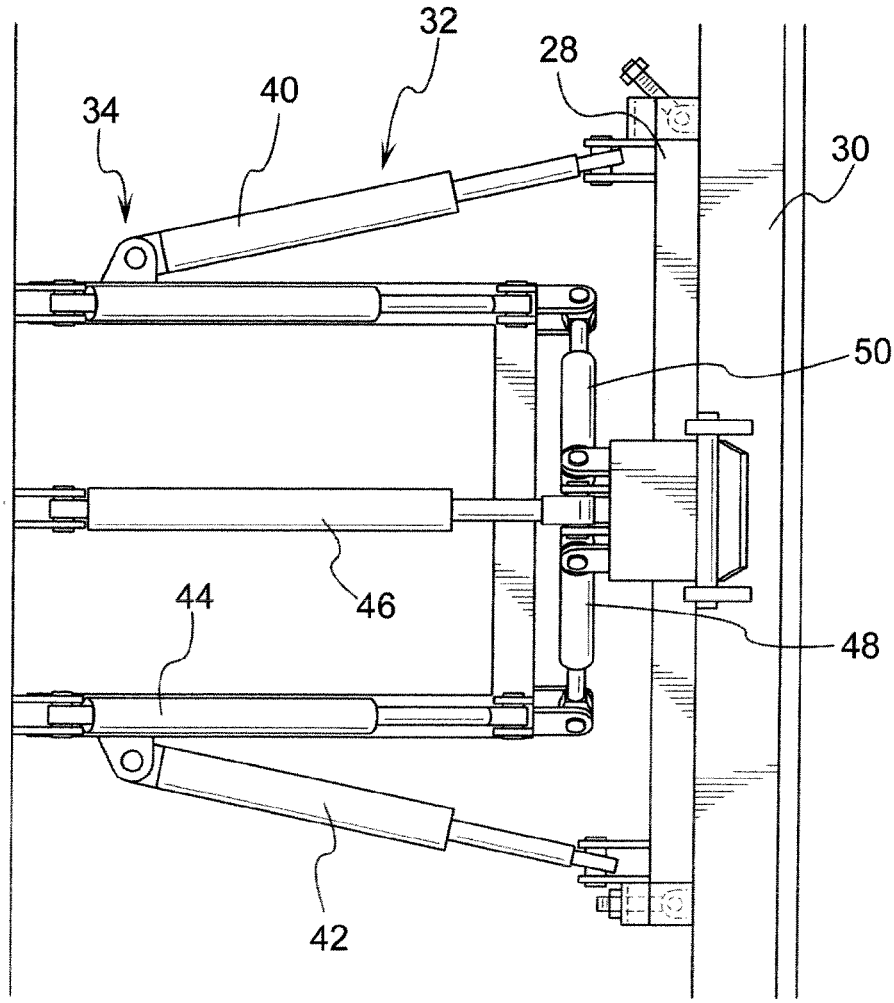
FIG. 4 shows a top view of one form of the actuating system.

To aid in the description, an axes system 10 is defined where the axis 12 indicates the longitudinal axis and the axis 14 shows a vertical axis. As shown in FIG. 2, the axis 14 indicates the lateral direction and more specifically points in a first lateral direction where the substantially opposing direction is referred to as the second lateral direction. There will now be a description of the snow track-type vehicle which is referred to as an over-snow track vehicle which the invention described below is adapted to operate in. It should be noted that the snow track-type vehicle device is shown in a somewhat schematic nature and can represent various commercially available snow track-type vehicles. In fact, a mounting plate described further herein is adapted to interface between the lifting device in the snow track-type vehicle's base mount so the lifting device can be exchanged to a different type and brand-name of snow track-type vehicle.

Figure 1:
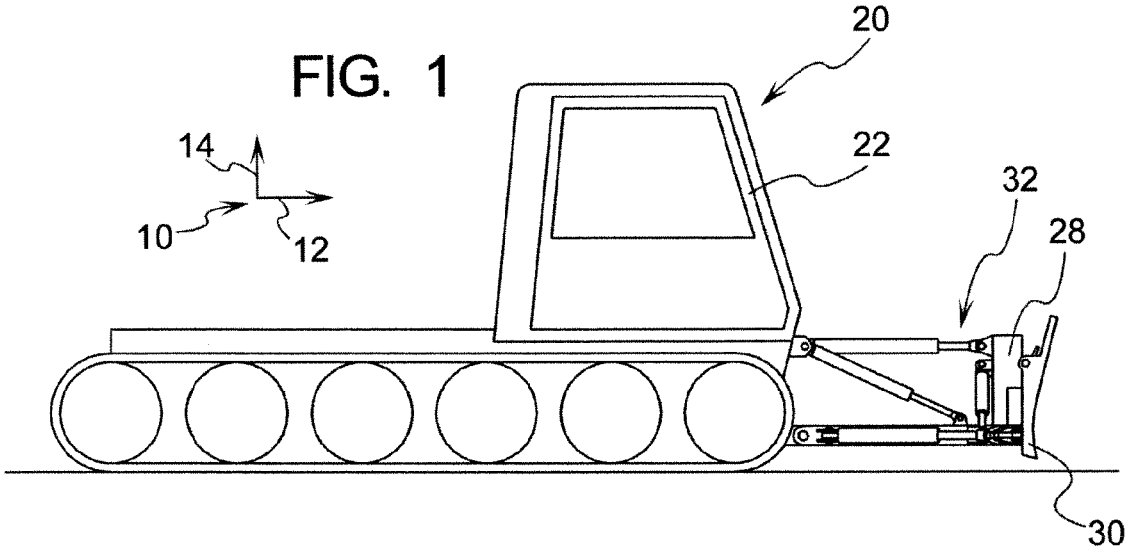
FIG. 1 shows a side view of a snow track-type vehicle, otherwise referred to as a snow tract transportation vehicle with an actuating system and a blade attached thereto.

As shown in FIG. 1, there is a tracked device which is commonly referred to as a snow-cat or a over-snow track vehicle. there are various types of over—snow track vehicles in the marketplace and as described herein, the lift device is particularly flexible to mount to these various different commercially available snow track-type vehicles.

Figure 21:
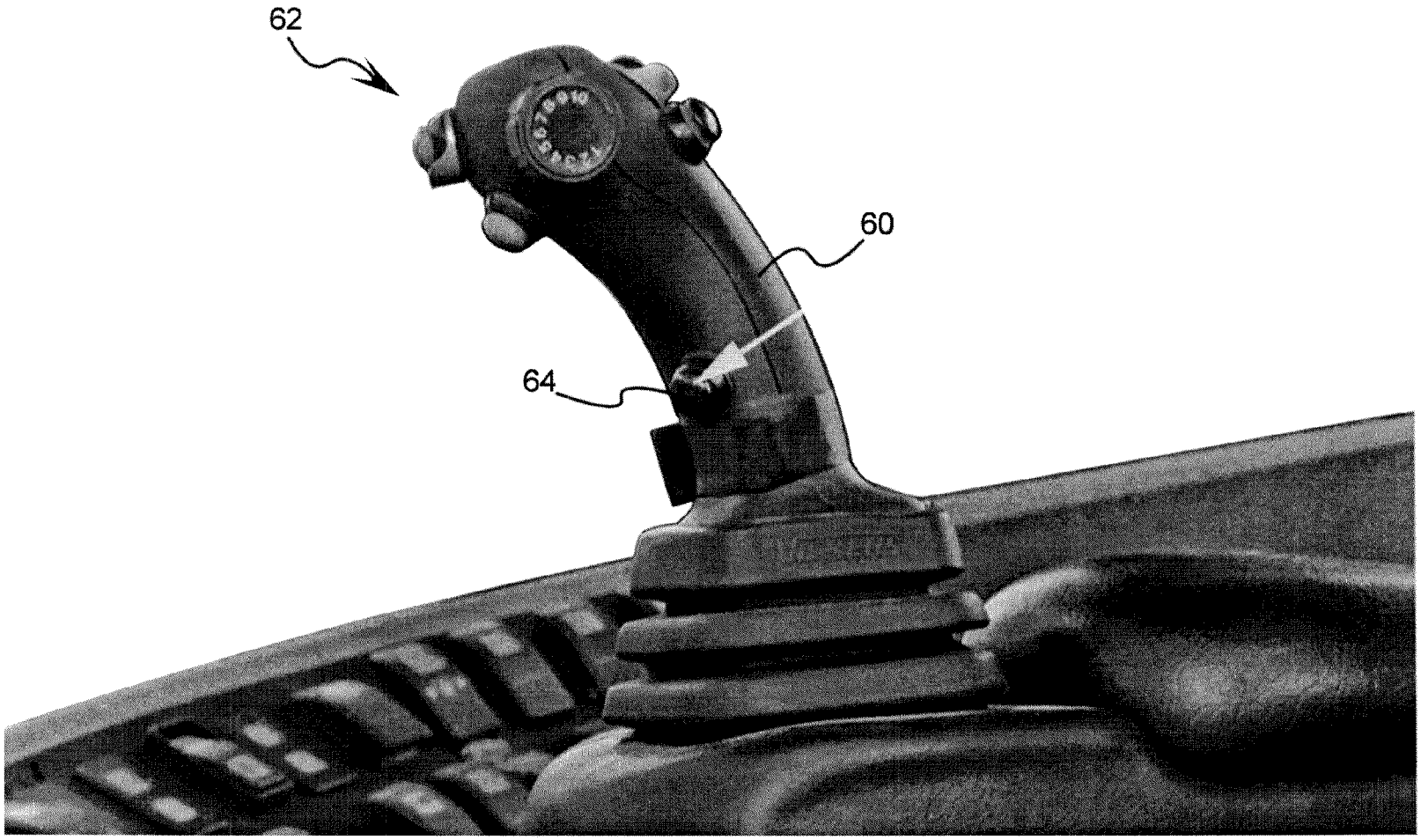
FIG. 21 shows a certain type of control interface member for one commercially available snow track-type vehicle.
Figure 22:
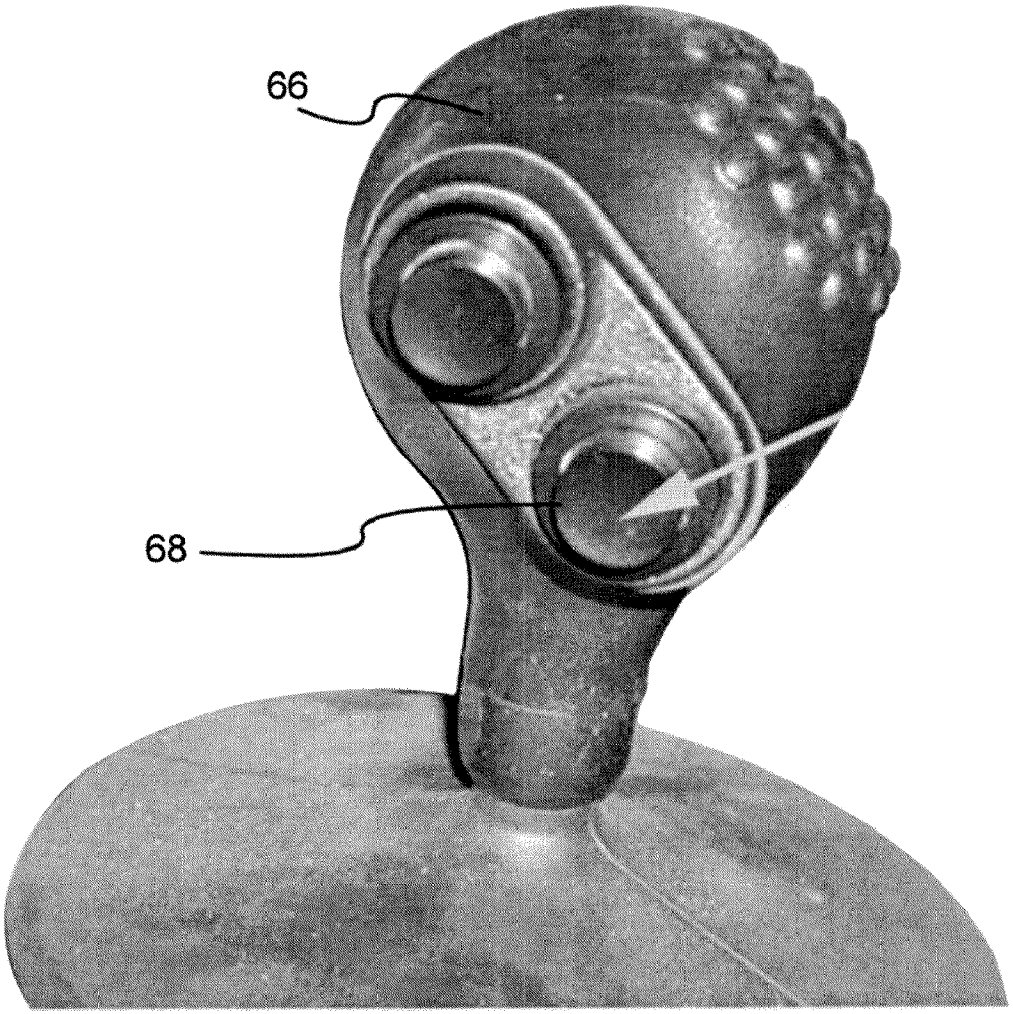
FIG. 22 shows another type of control member for another commercially available snow track-type vehicle.

In general, the over-snow track vehicle 20 comprises a cab 22 and a track drive 24. Further, in the front portion of the snow track-type vehicle 20 is an actuating system that is adapted to reposition the base mount 28. As shown in FIGS. 1 and 2, a blade 30 is fixedly and removably attached to the base mount 28. The base mount 28 is further shown in FIGS. 3 and 4. It should be noted that various commercial entities have different base mounts and blades adapted to fit thereto. The over-snow track vehicle actuating system 32 is comprised of a plurality of hydraulically driven pistons generally indicated at 34. Of course the pistons can operate in a variety of manners to reposition the base mount to numerous orientations. When grooming a slope, the base mount 28 and the blade 30 attached thereto must be orientated in a variety of positions to properly groom a slope. Therefore, the operator of the snow track-type vehicles 20 must be very familiar with the plurality of controls which are described further herein. In general, the plurality of pistons comprise the lateral twists pistons 40 and 42. Further, there is a lifting piston 44 and a front tilt piston 46. Further, the longitudinal twist pistons 48 and 50 are adapted to rotate about the longitudinal axis. As shown in FIGS. 21 and 22, there are two different control systems that are positioned within the cab 22 of the snow track-type vehicle 20 (see FIG. 1). In general, these joystick control systems are for two different commercially available snow track-type vehicles. These two systems are shown by way of example. As described further herein, the control system to utilize the lifting device is almost seamlessly integrated and applies proper principles of human factor engineering to integrate the utilization of the lifting device with existing controls. As shown in FIG. 21, the joystick device 60 has an upper control region 62 having a plurality of controls. This specific control interface is adapted from the piston bully device.

Attention is now directed to the lower portion of the control system where the button indicated at 64 is adapted to control the winglets which will be described herein below with reference to FIG. 2. Now referring to FIG. 22, there is shown a second control system which is substantially different from the control system as shown in FIG. 21; however, the joystick 66 is provided with a button 68 that is adapted to control the winglets as shown in FIG. 2.

FIGS. 21 and 22 are adapted to illustrate the stark differences between the various commercially available control systems between different brand-name snow track-type vehicles. As schematically illustrated by the controls, there is in general a tremendous amount of variation in the control systems, which requires a degree of training by the snow track-type vehicle operator.

Now referring back to FIG. 2, there is shown a picture of the winglets 80 and 82 located in the first lateral portion and the second lateral portion respectively. The winglet actuators 84 and 86 are adapted to control the winglets to hydraulically position them from the first position as shown in the lower portion of FIG. 2 indicated at 88, to a second position indicated by the hatched line at 90. As noted above, these winglets are controlled by the control system as shown in FIGS. 21 and 22 by buttons 64 and 68 respectively. Of course, the control system can vary from other types of commercially available snow track-type vehicles, and these are shown to represent two variations.

There will be further discussion of the hydraulic lines that are in hydraulic communication with the actuators 84 and 86 with respect to the lifting device described herein.

Figure 5:
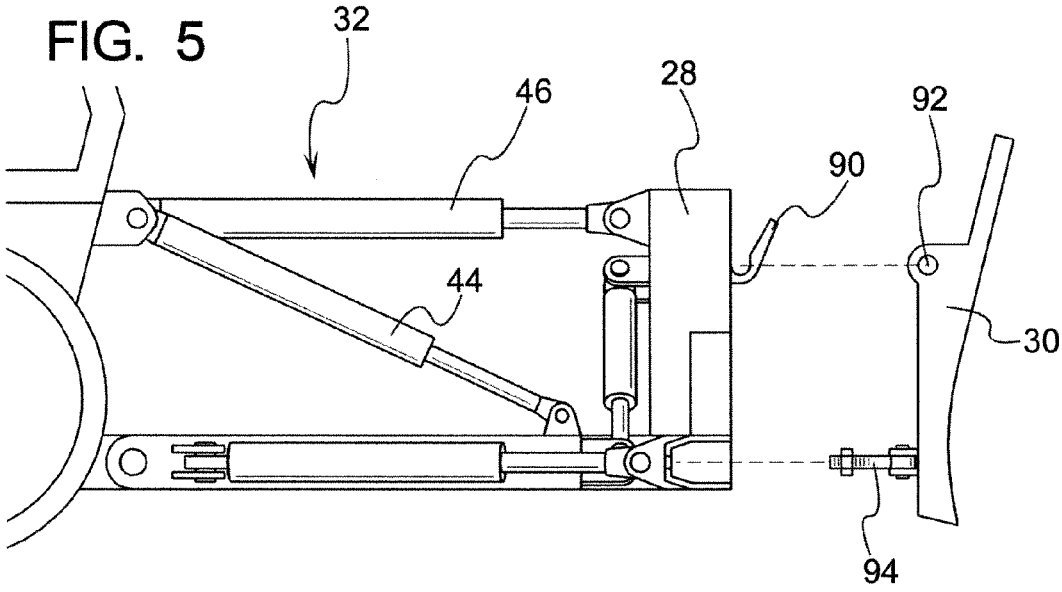
FIG. 5 shows a side view of the front portion of the snow track-type vehicle where it is illustrated how the blade attaches and is detached from the base mount.
Figure 6:
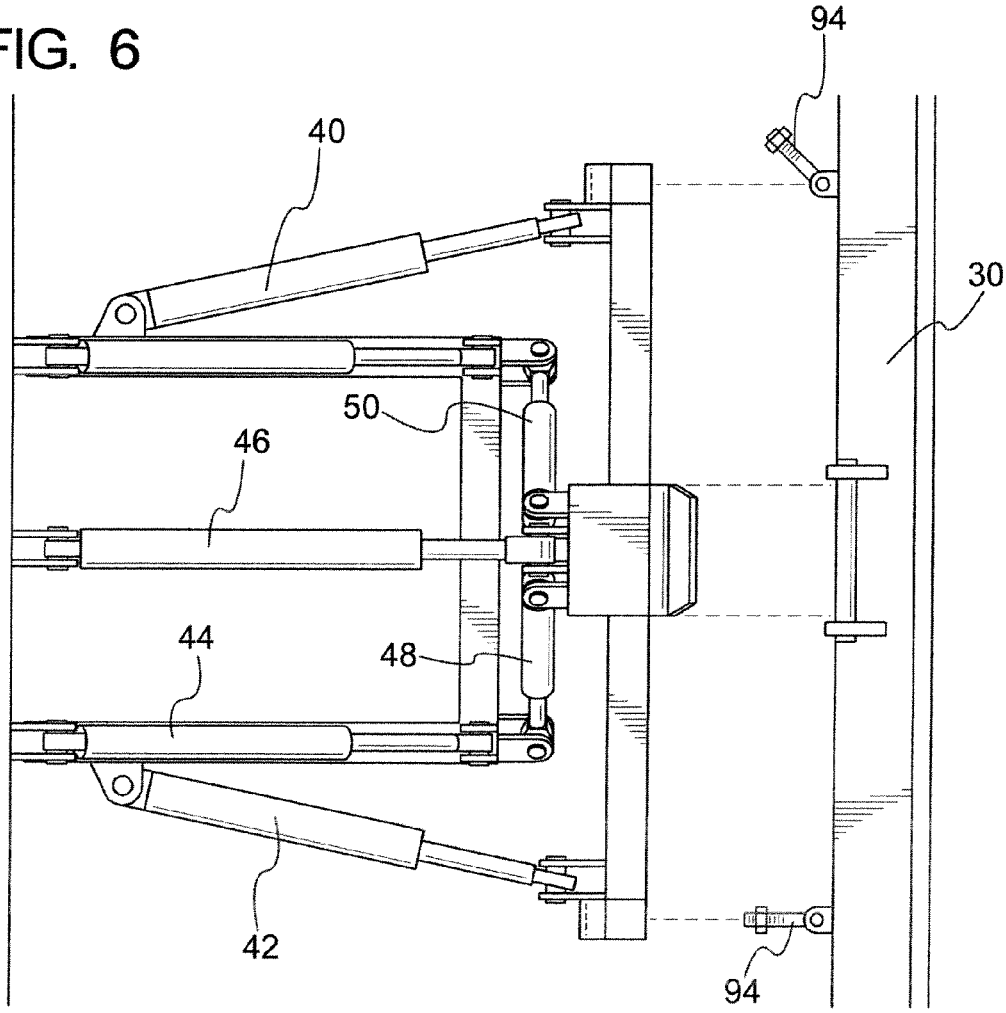
FIG. 6 shows a top view of the method of attaching and detaching the blade from the base mount.
Figure 7:
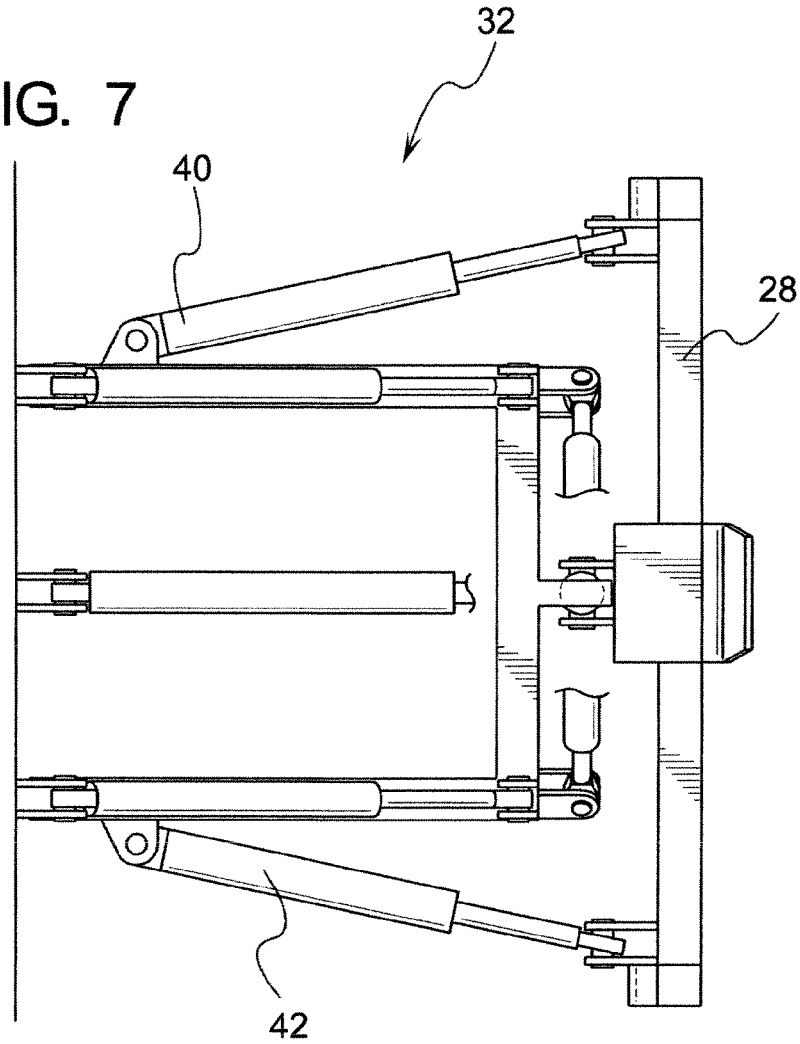
FIG. 7 shows a top view of the actuating system with a partial break-away section of the longitudinal twist actuators.
Figure 8:
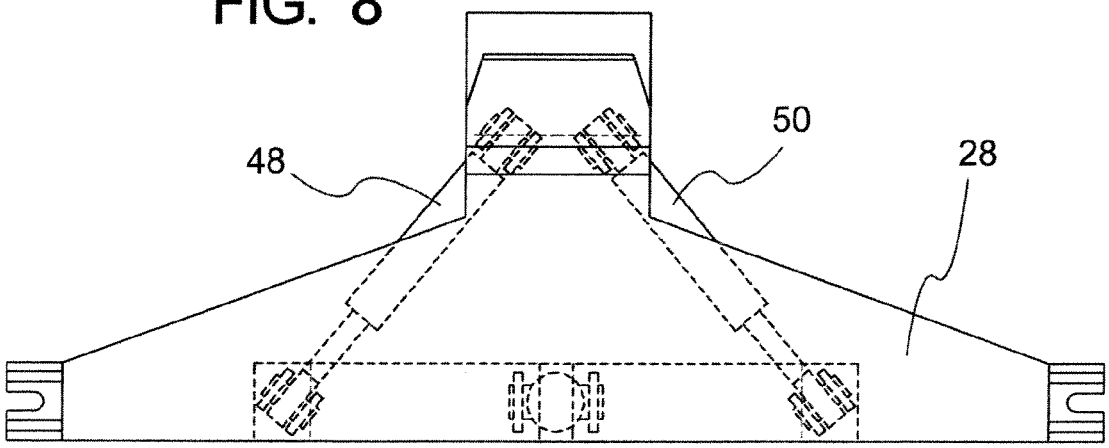
FIG. 8 is a front view of the base mount showing the longitudinal twist actuators.

As shown in FIG. 5, there is shown one form of the base mount 28 that is adapted to have the blade 30 attached thereto. In one form, an upper hook portion 90 is adapted to gauge a laterally extending bar 92. A fastener 94 such as a bolt and nut assembly fixedly and removably attaches the blade 30 to the base mount 28. Therefore, it can be appreciated that the base mount 28 provides a mounting platform. FIG. 7 shows the actuating system 32 and the base mount 28 is shown in the top view. FIG. 8 shows the longitudinally twist actuators 48 and 50 which are adapted to reposition the base mount about the longitudinal axis.

Figure 9:
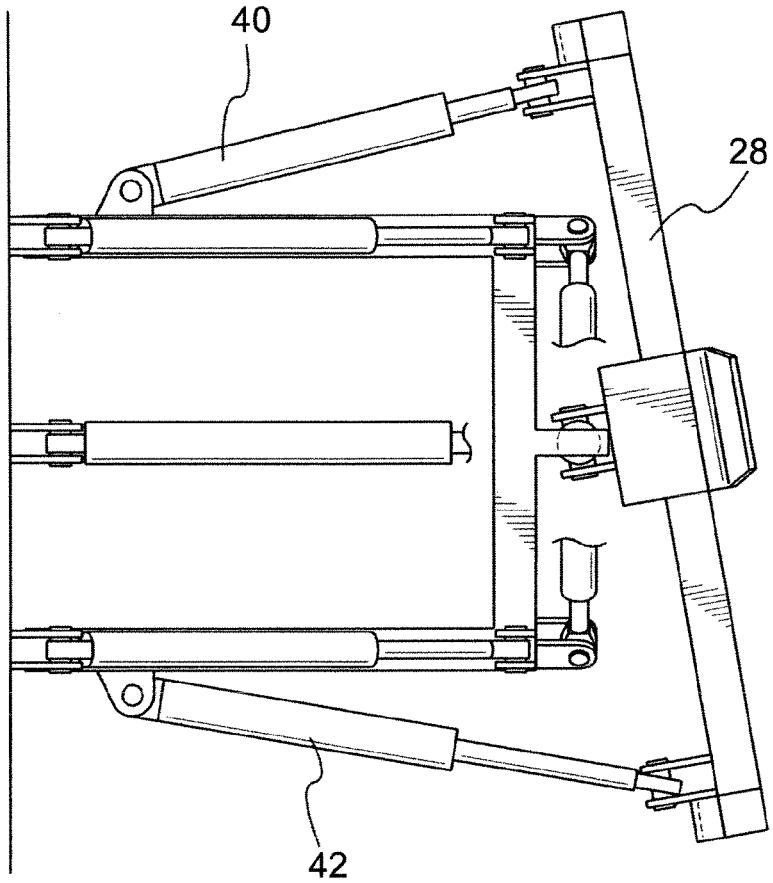
FIG. 9 shows the lateral twist actuators repositioning the base mount.
Figure 10:
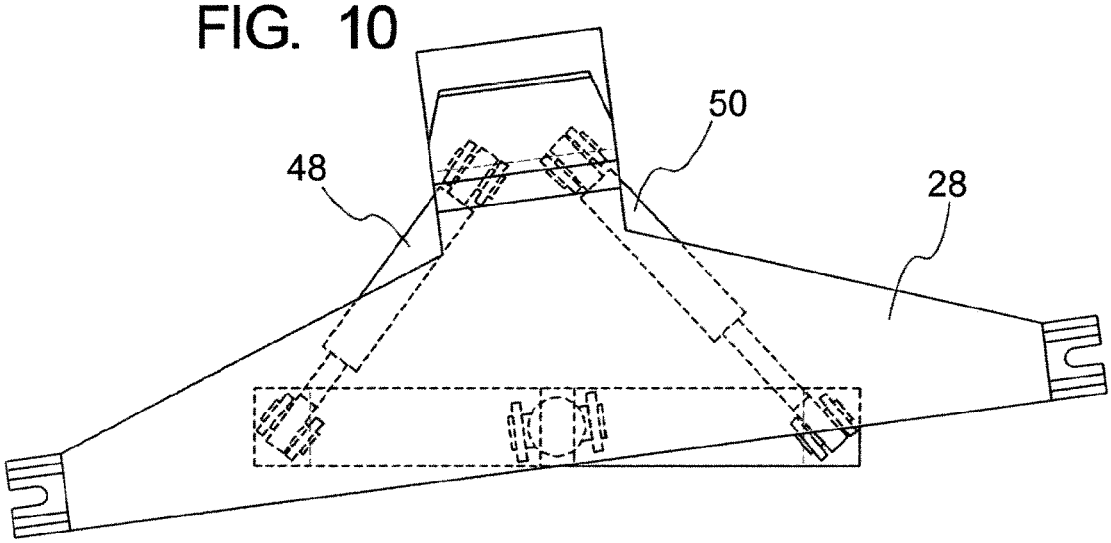
FIG. 10 shows the longitudinal twist actuators rotating the base mount about a longitudinal axis.
Figure 11:
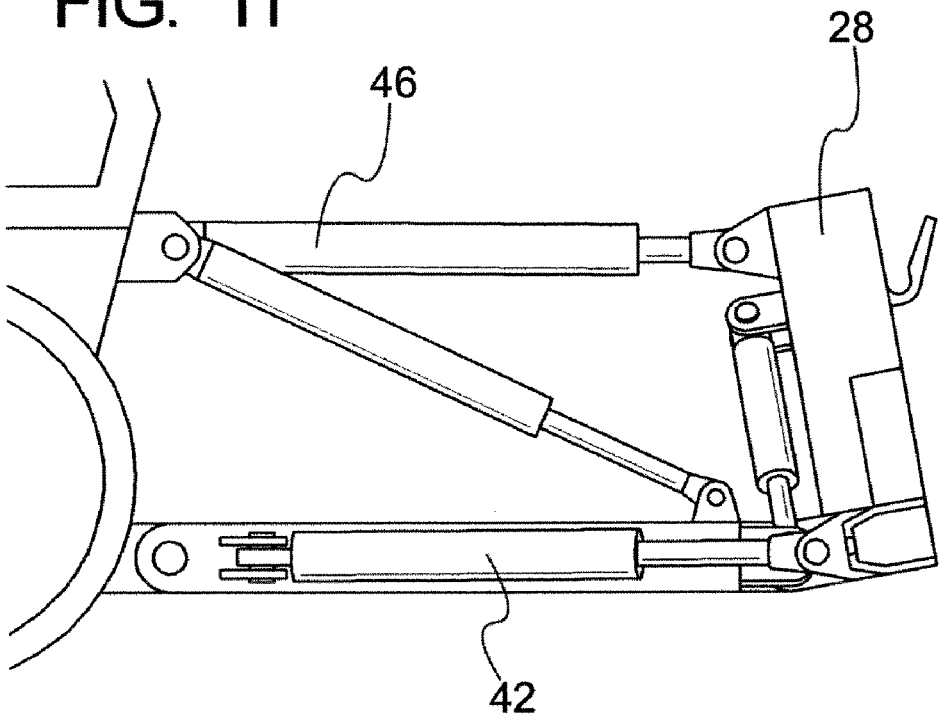
FIG. 11 shows the front tilt actuator rotating the base mount about a lateral axis.

FIG. 9 shows the lateral twist actuators 40 and 42 repositioning the base mount 28 substantially about a vertical axis. FIG. 10 illustrates how the mounting plate 28 can be repositioned in a variety of orientations given the actuating system. These orientations have been found to be useful for grooming slopes in accordance with the various demands by skiers. FIG. 11 illustrates how the front tilt actuator 46 can rotate the base mount 28 substantially about the lateral axis. Now referring to FIG. 12, the lift actuator 44 operates at a slider crank-like linkage mechanism to lift and rotate the base mount 28 about the pivot region 45.

Therefore, it can be appreciated that there are a plurality of positions and orientations in which the base mount 28 can be arranged.

Figure 13:
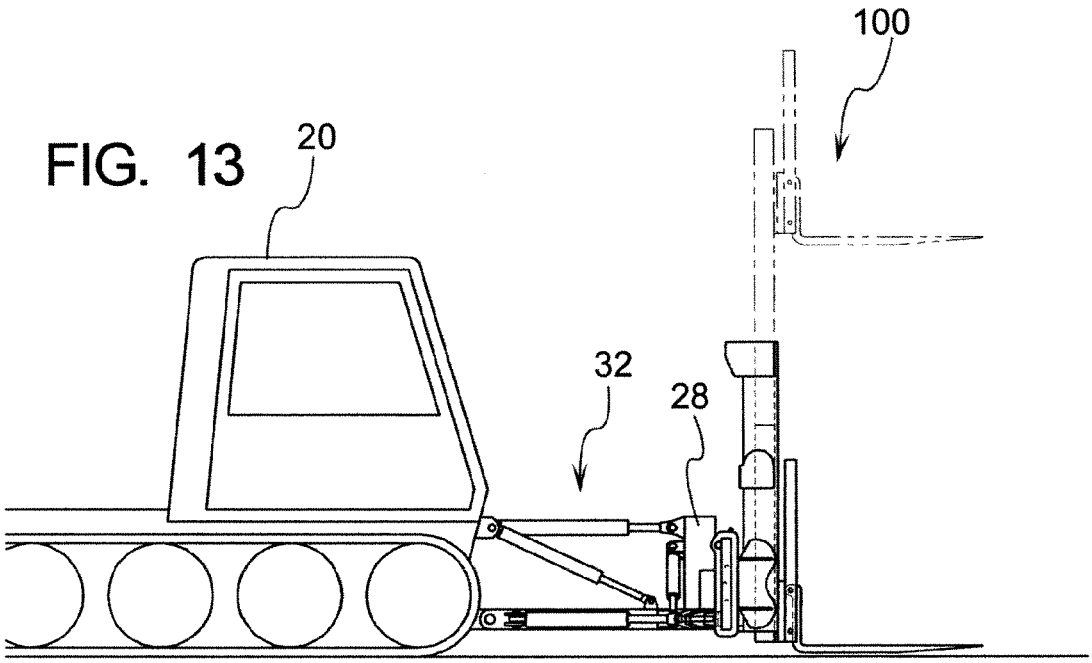
FIG. 13 shows a side view of the lifting device attached to the snow track-type vehicle.
Figure 14:
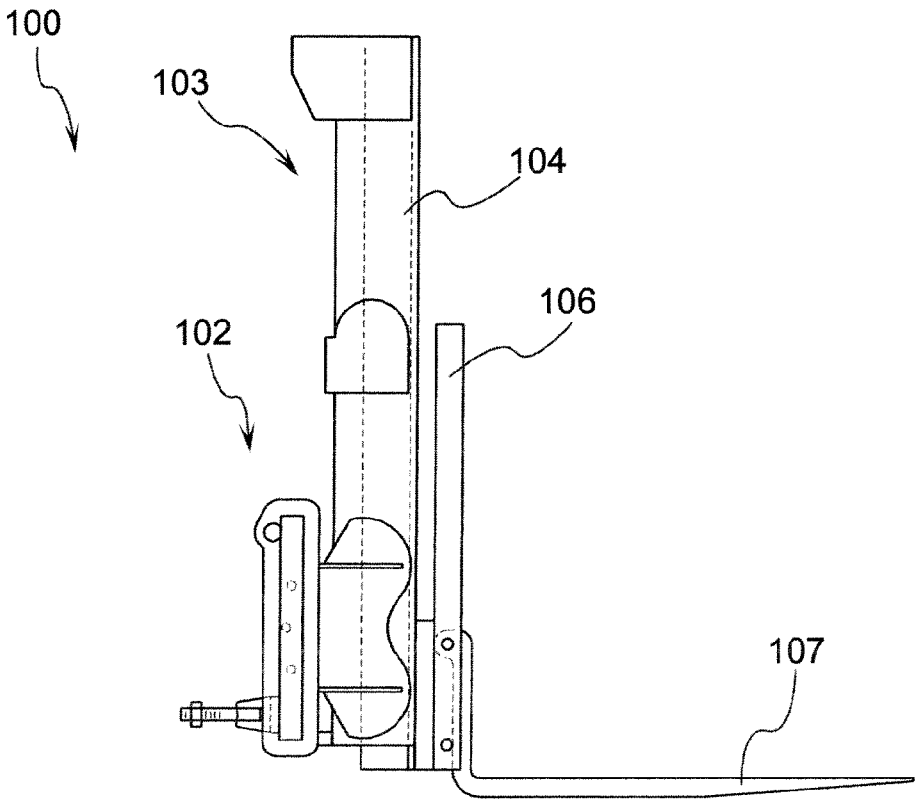
FIG. 14 shows the lifting device.
Figure 23:
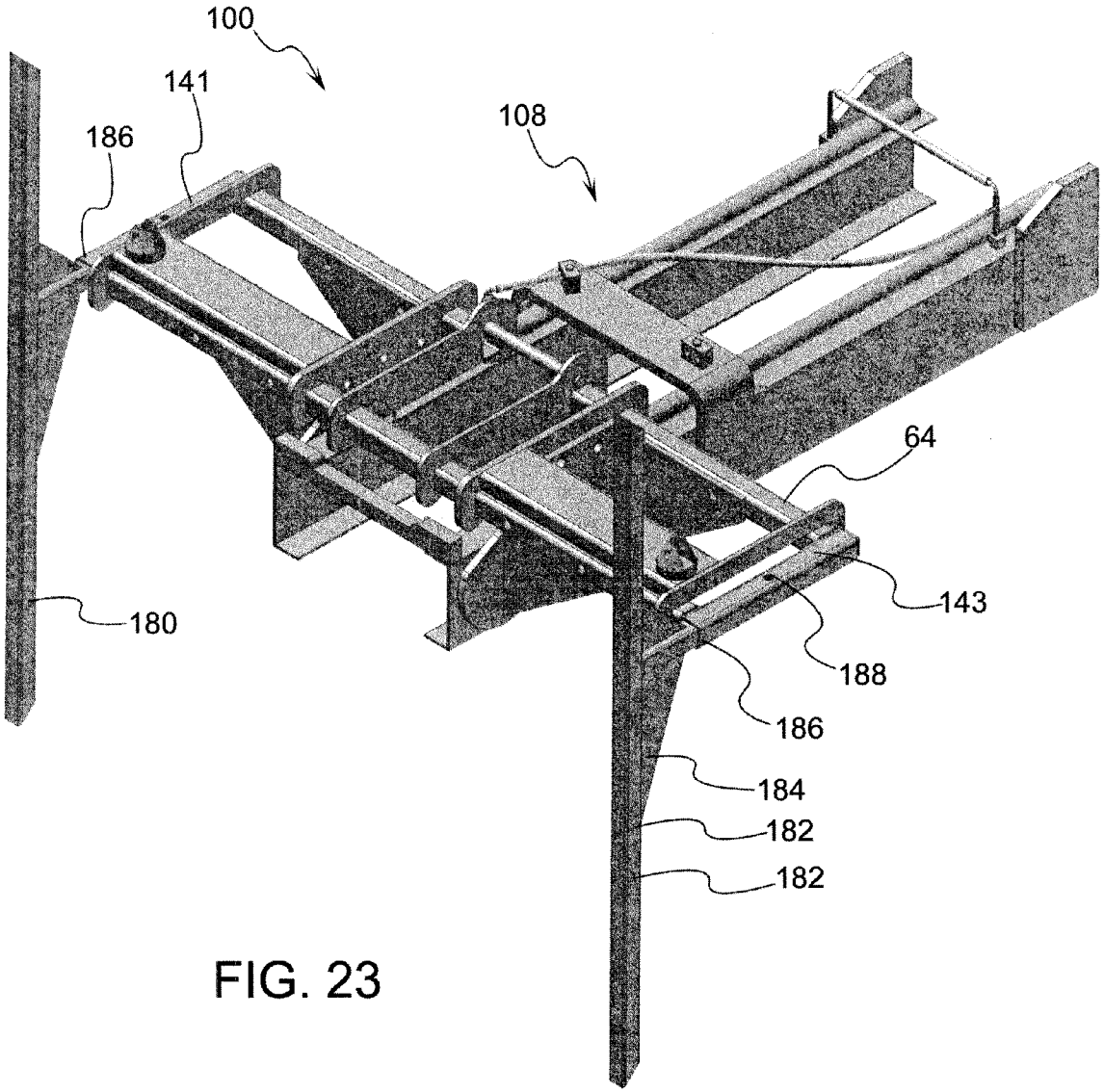
FIG. 23 shows an assembled view of the lifting device without the carriage illustrating the hydraulic system.

It should be noted that a lifting mechanism in a dynamic environment such as a sloped snow region having various gradients of slope which are desirable for skiing, has to operate and be adjustable for such an environment. Now referring to FIG. 13, there is shown a lifting device 100. In general, the lifting device 100 as shown in FIG. 14 comprises an interface portion 102, a mast region 104, and a carriage 106. Further, the lifting device 100 comprises a hydraulic system 108 which is best shown in FIG. 23 and FIG. 24.

Figure 17:
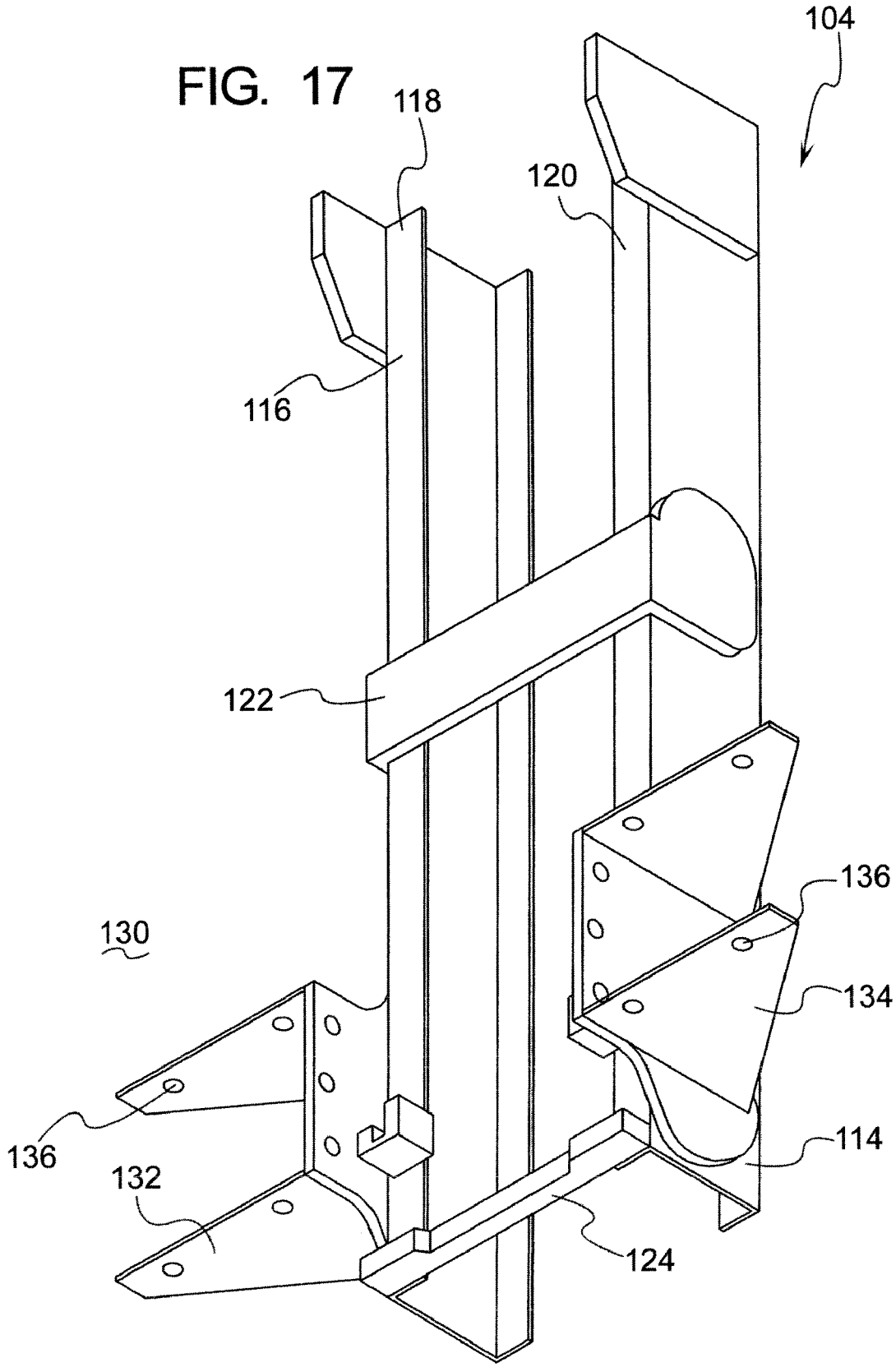
FIG. 17 shows a portion of the mast without the hydraulic system.
Figure 24:
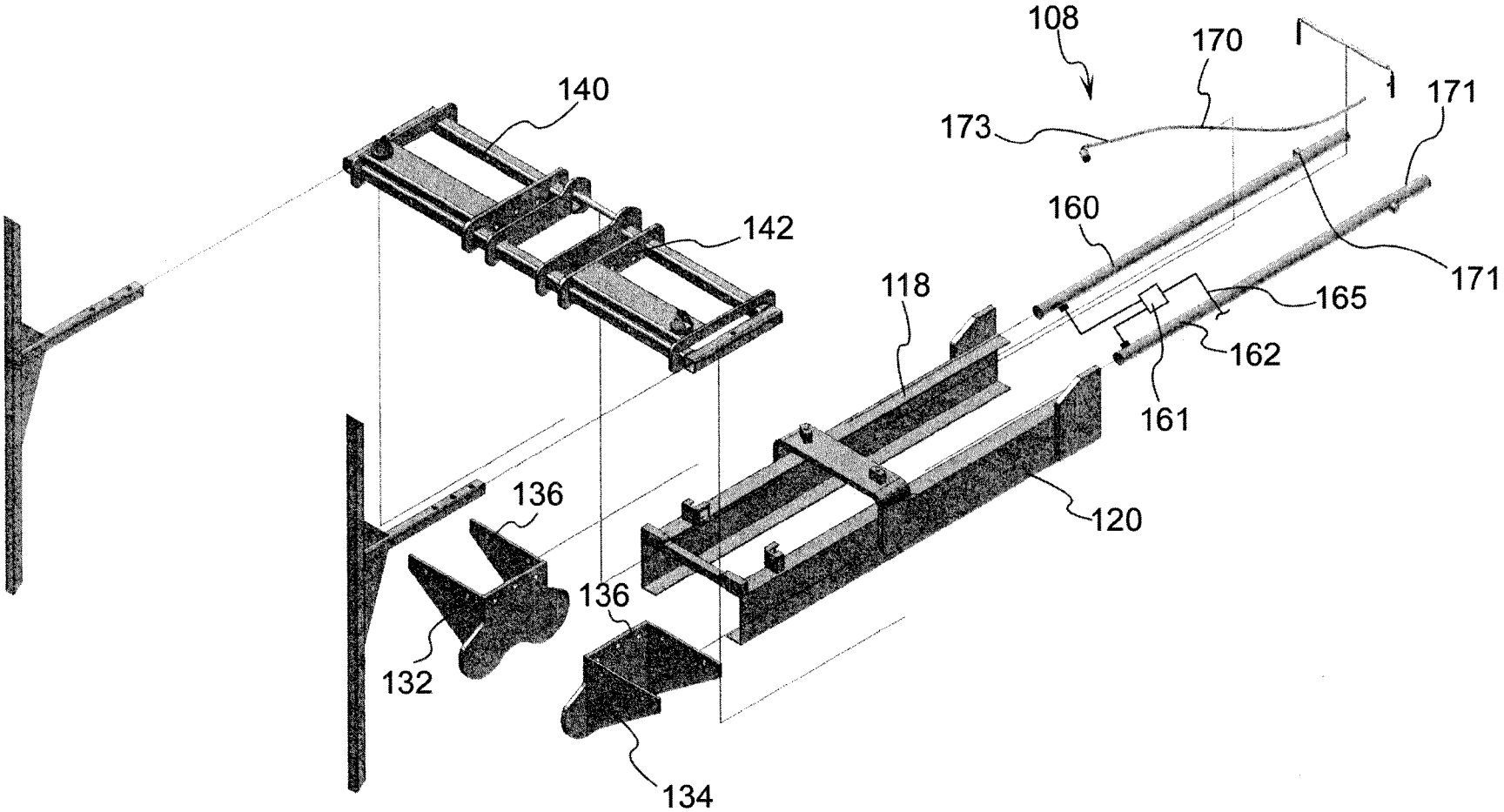
FIG. 24 is a partial exploded view of the lifting device without the carriage portion.

Essentially, FIG. 14 further shows the lifting device 100 where there is an operating region 103 that is comprised of the mast 104, carriage 106 and the hydraulics 108 as shown in FIG. 24. As shown in FIG. 17, there is illustrated an example of a mast 104. In general, the mast 104 has a lower portion 114 and an upper portion 116. In one form, the mast 104 is comprised of first and second C-channel members 118 and 120. Fixedly attached cross-members 122 and 124 keep the members rigidly attached one another. Located in the lower portion 114 is the uniform attachment interface region 130. In one form, the uniform attachment interface has left and right lateral members 132 and 134 that comprise a plurality of attachment portions 136.

The carriage 106 comprises forks 107 as shown in FIG. 14. The forks 107 are common types of forks that are conventionally available for forklifts.

Figure 16:
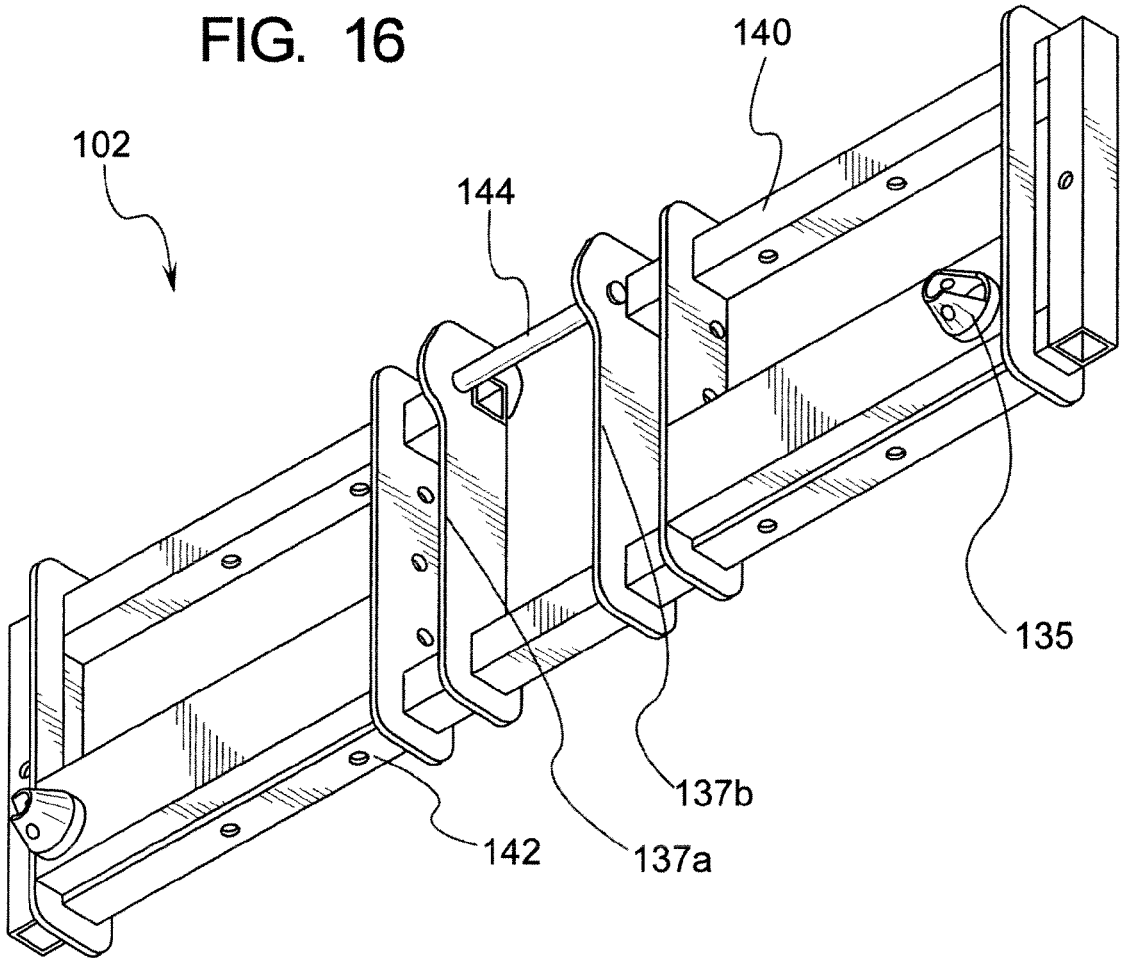
FIG. 16 shows one example of a mounting plate.
Figure 19:
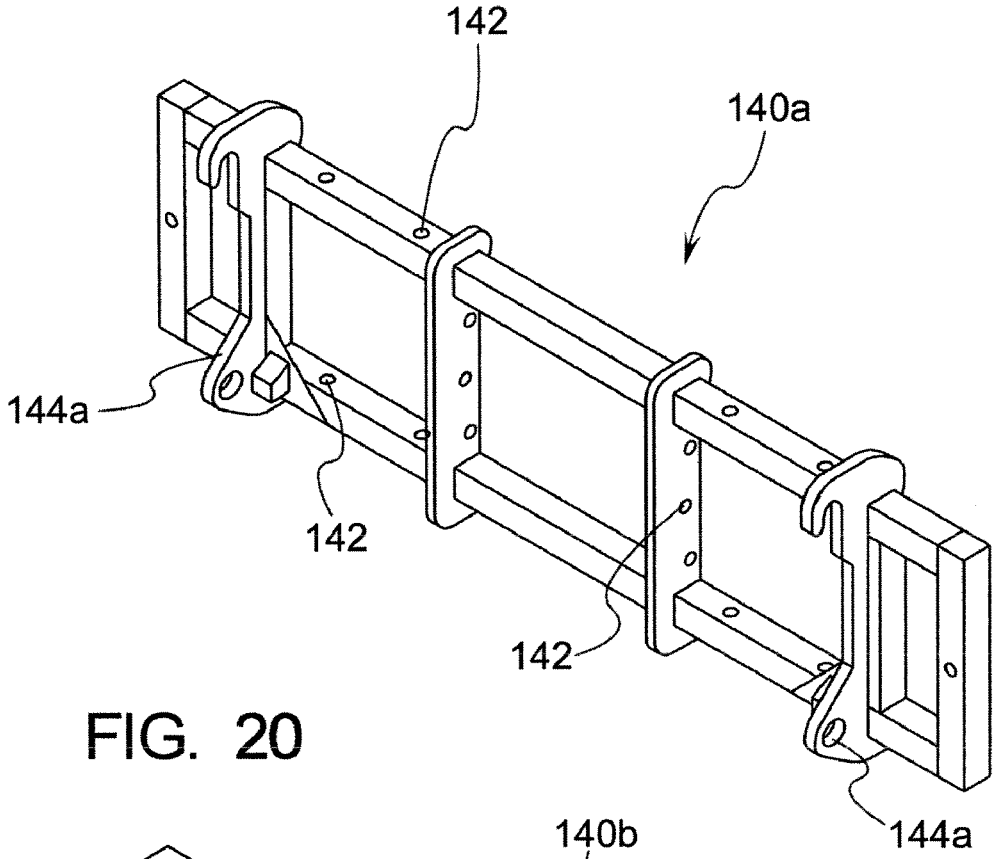
FIG. 19 shows a different style of mounting plate for another type of snow track-type vehicle such as the Prinoth®.
Figure 20:
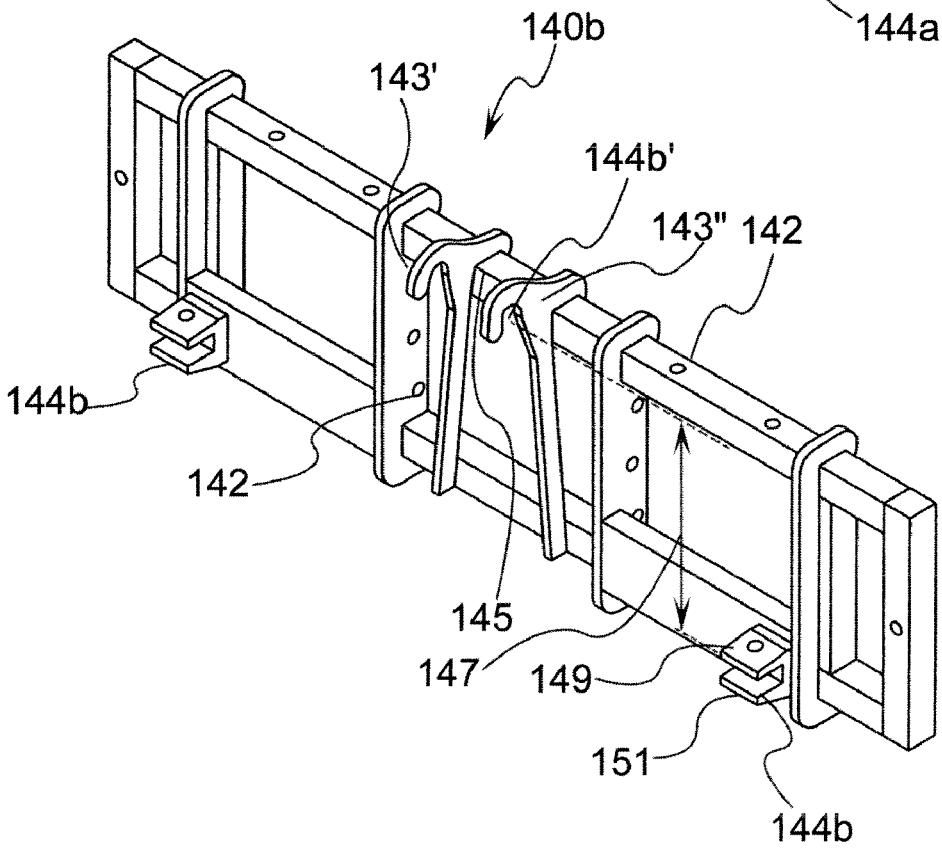
FIG. 20 shows another type of mounting plate for a commercially available snow track-type vehicle such as the Prinoth Terrain Master 350®.

Now referring to FIG. 16, there is shown an example of a mounting plate. The mounting plate as shown in FIG. 16 is a mounting plate that is adapted to engage the base mount of a piston bully to a type of snow track-type vehicle. However, the mounting plate is defined extremely broadly to provide the operation of interfacing between the operating region of the lifting device and the base mount 28 of the over-snow track vehicle. FIG. 16 essentially shows a mounting plate which is a portion comprising the interface portion 102 as shown in FIG. 14. The interface portion 102 comprises the mounting plate 140 which has a lifting device mounting region 142 and a base mount attachment region 144. FIGS. 19 and 20 show other forms of mounting plates **140*a* and 140*b*. The mounting plate 140*a* is one type where the base mount attachment region 144*a* is adapted to fit to a base mount for one style of Prinoth style over snow track vehicle. Further, the mounting plate 140*b* in FIG. 20 has a base mount attachment region 144*b* is adapted to fit to a base mount for a Prinoth-Terrain Master® 350 style over snow track vehicle mount. It should be noted that the lifting device mounting region 142 in FIGS. 19 and 20 is similar to that as shown in FIG. 16. Of course various other types of configurations can be utilized where it can be appreciated that the mounting plate is adapted to interface between the operating region 103** of the lifting device and the base mount or similar structure of a over snow track vehicle. It should be noted that the mast can be welded or bolted to the mounting plate. By having the mounting plate fixedly and removably attached to the mast, the forklift member can be used on other over-snow track vehicles of a different model.

Figure 12:
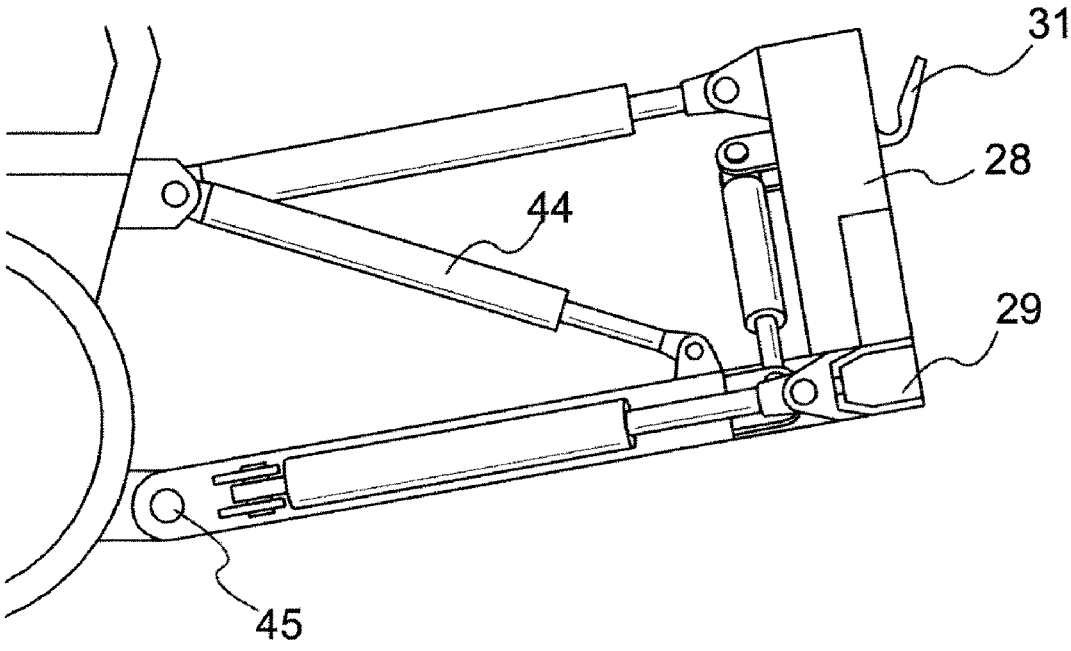
FIG. 12 shows the lifting actuator raising the base mount and rotating about a point near the mounting region of the actuating system.

It should be noted that the bar members 143' and 143" have a dimension component 145 which is wider than the specifications of the over-snow track vehicle manufactured for this particular unit. Present analysis and experimentation indicates that the prescribed dimensions of this mounting interface on the actual Cat can be out of tolerance. Therefore, by increasing the dimension 145 by, for example, a quarter of an inch in one range (and this range could be expanded by 50% and go from an eighth of an inch to one inche in the broader scope) where, for example, spacing members can be placed therein to take up the slack or other types of retrofit type spacing elements. Further, referring to FIG. 20, it can be seen that the upper base mount attachment region 144*b*', for example, in general is required to have a fairly precise distance from the lower base mount attachment region 144*b*, where the dimension component 147 illustrates the prescribed dimensions to interface to the particular over-snow track vehicle. As shown in FIG. 12, the recessed region 29 is adapted to interface with the swing boat blocks 135 which are defined as a base mount attachment region. In a similar manner the mounting plate 140*b* of FIG. 20 is mounted to a similar style over-snow track vehicle interface as shown in FIG. 12. Therefore, by ensuring that the upper and lower surfaces 149 and 151 in FIG. 20 are in closer engagement to one another by approximately an eighth of an inch, which can be plus or minus 50% in the broader range, provides enough clearance to fit to the various base mounts 28 such as that shown in FIGS. 11 and 12 which tend to vary in their manufacturing tolerances. Further, now referring to FIG. 16, the plate members 137A and 137B are also slightly widened to interface with, for example, the base mount 28, and more particularly the hook member 31. It should be noted that the swing boat blocks 135 are adapted to fit within the recess 29, and are constructed on the interface member 102 to have a smaller frustroconical dimension by, say, one-eighth of an inch to fit to the various manufacturing tolerances. Again it should be reiterated that the lower member 144B is not adapted to fit to the particular base mount 28 where this particular base mount 28 is adapted to interface with the type of interface member shown in FIG. 16. But the general principle applies where the upper and lower surfaces are recessed within a cavity-like member, which is common for that particular brand of manufacturer.

Figure 15:
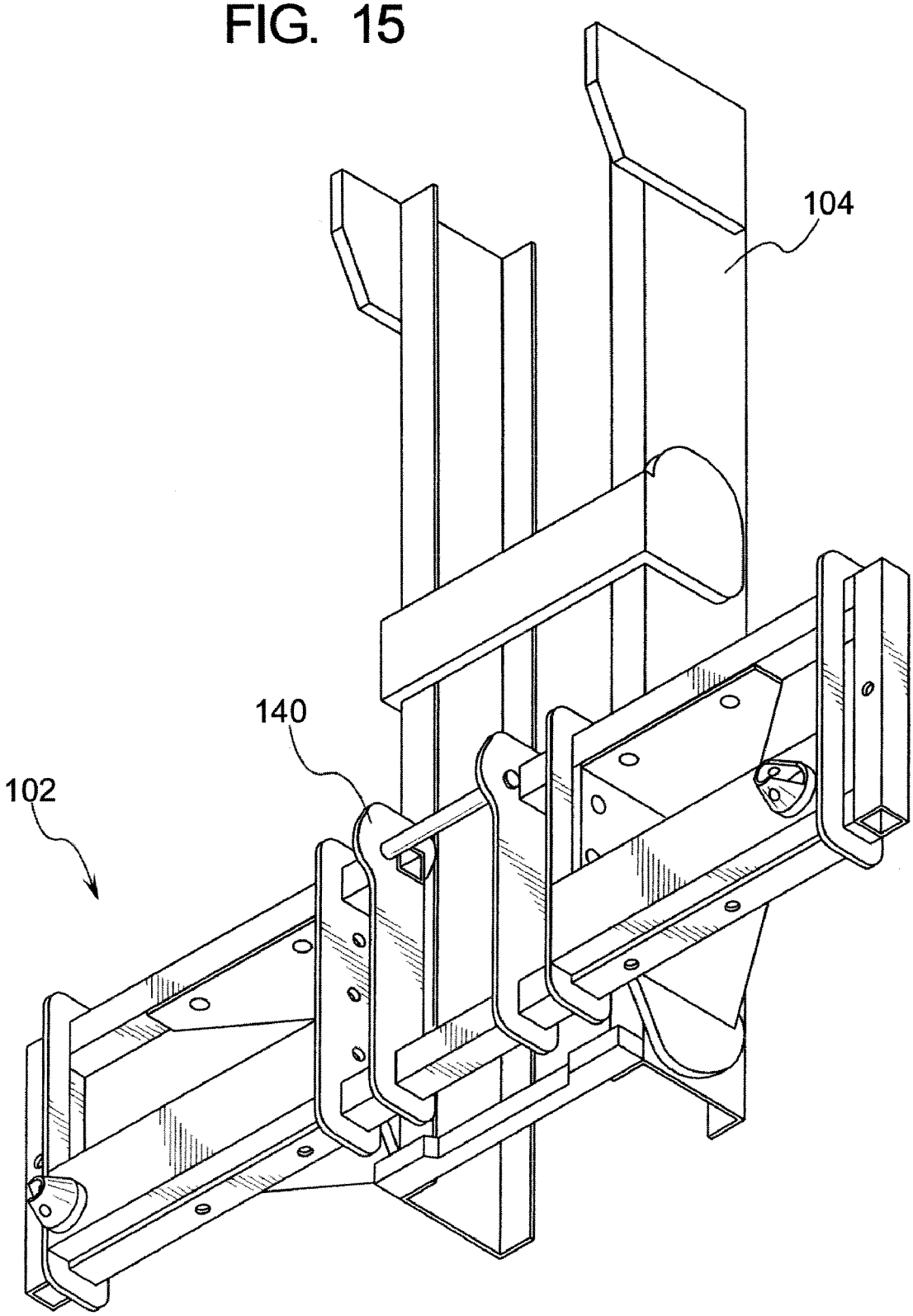
FIG. 15 shows a portion of the lifting device including the mounting plate and the mast.

As shown in FIG. 24, there is an exploded view of the assembly where the mounting plate 140 is shown. The mounting plate is adapted to be positioned adjacent to the first and second members 132 and 134, which in one form are rigidly attached to the C-channel members 118 and 120, such as by way of welding. The attachment portions 136 which in one form are a plurality of surfaces defining holes to allow bolts to pass therethrough, correspond in location to the lifting device mounting region 142 of the mounting plate 140. As shown in FIG. 15, there is an isometric view of the mast 104 attached to the mounting plate 140.

Figure 18:
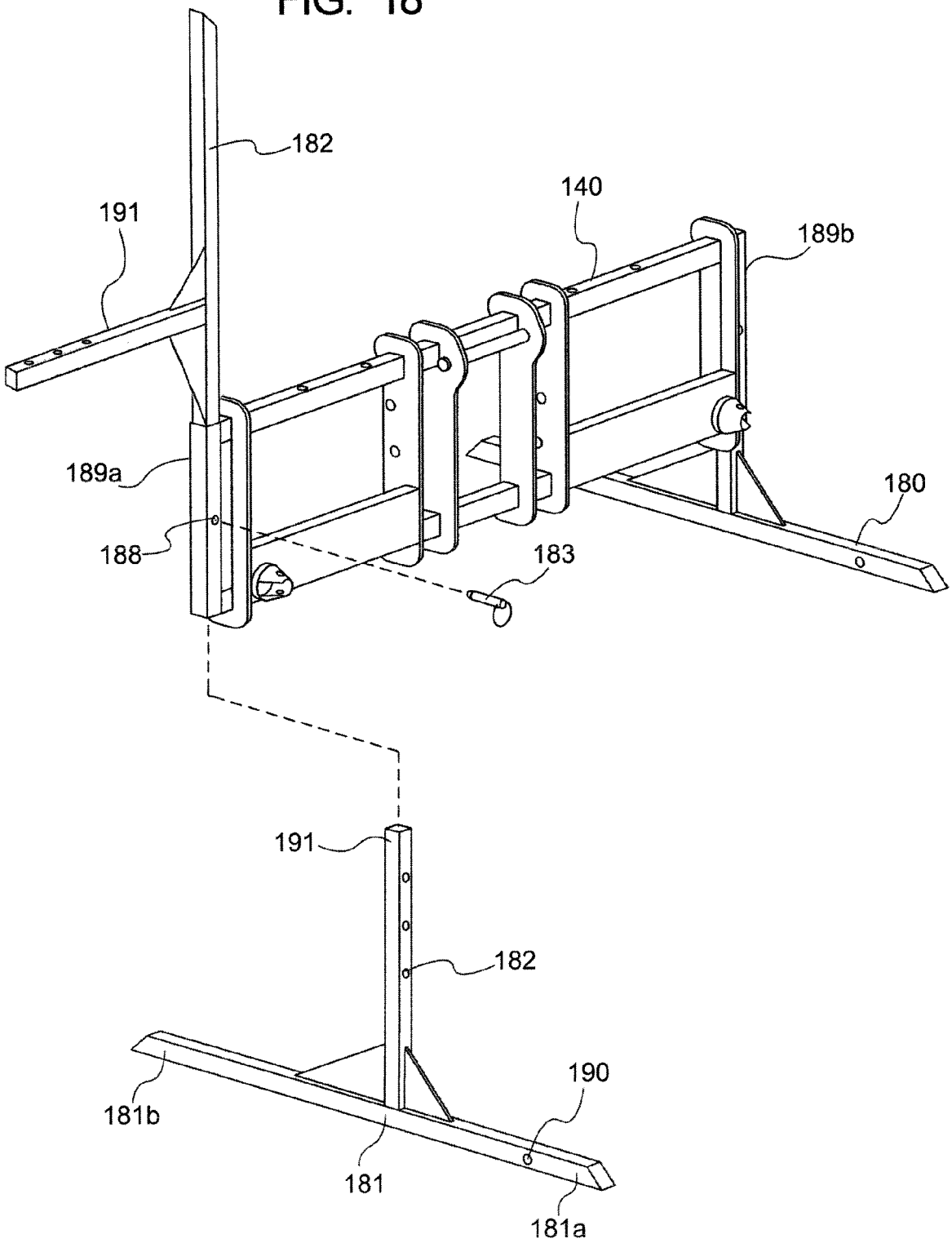
FIG. 18 shows the mounting plate where stand posts are shown in an operating position and in a stored position.

Now referring back to FIG. 24, there will be a discussion of the hydraulic system 108. As shown in this isometric view, the first and second drive actuators 160 and 162 are adapted to operate a hydraulic ramp that is in communication with the carriage 106 (see FIG. 14). It should be noted that the drive actuators are in hydraulic communication with the hydraulic lines that normally hook up to the winglets as shown in FIG. 2. It should be further noted that positioned in the upper region of the drive actuators 160, there is a hydraulic connection member that is in hydraulic communication with the upper portion of the drive actuators 160 and 162. In other words, hydraulic fluid positioned in the upper portion of the drive ramp is pushed outwardly through line 170 and back to the hydraulic system of the snow track-type vehicle. When the carriage is lifted outwardly, the hydraulic fluid contained in the upper portion of the interior ramp of the actuators 160 and 162 thrusts fluid outwardly through line 170 as shown in FIG. 24. A hydraulic circuit is required to properly interface with the existing hydraulic system thereof. As shown in FIG. 23, there is an assembled view of the lifting device 100. In one form, positioned in the first and second lateral regions 141 and 143 of the mounting plate 140, are channel portions adapted to have the stand posts 180 and 182 positioned therein. In general, the stand posts have a base region and a mounting region 184 and 186 respectively, and an opening 188 can be defined in the lateral regions of the base mount to allow a pin to be extended therethrough. Referring now to FIG. 18, it can be seen that the stand post attached to the base mount and the pin 183 can further be utilized to fixedly attach the stand mounts 182 in a stored position as shown in the upper left-hand portion of FIG. 18. Of course, when the lifting device is not utilized, the stand posts 180 and 182 can properly store the lifting device 100 in a substantially vertical position for easy attachment to the base mount (see FIG. 13).

Now referring to FIG. 18, it should be noted that the mounting receptacles 189*a* and 189*b* are positioned sufficiently wide enough to allow the base mount 28 to position widely enough to allow the base mount to fit in the interface region to attach thereto. It should be further noted that the support post 191, when positioned in the stored orientation as shown in the upper portion of FIG. 18, is positioned laterally outward. The benefit of having the support post portion 191 positioned laterally outwardly is that if a certain large load is positioned on the forklift assembly, in a dynamic situation this load can reposition and rotate around the tines. Therefore, this member 191 having the front surface is adapted to protect it from being struck with any type of load which may swing off to the side and rearwardly of the forklift. Of course, either the forward or rearward regions of the support base 181 can be utilized to fit within the mounting member 189. Referring to the lower portion of FIG. 18, leg portion 181*a* is shorter with respect to the distance from the support post 191 and the leg portion 181*b*. Therefore, depending upon the size of the load in a vertical direction or the preferred carrying height and other factors, the laterally extending element of the support post 191 can be adjusted by inserting either 181*a*,182, or 181*b* within the mount receptacle 189.

As further shown in FIG. 24, there is shown the actuating members/pistons 160 and 162 where it should be noted that common pistons that are normal forklifts do not have any provisions for the upper chamber region above the cylinder member. Therefore, given the inherent aspects of a common forklift where there may not be a pump but where hydraulic fuel sits within a circuit and when one cylinder is displaced, the opposing portion must be filled with the hydraulic fluid. Therefore, the upper inlet ports 171 are provided where the inlet 173 of the line 170 is hooked up directly to the over-snow track vehicle's hydraulic line. Therefore, there must be slight modification to the first and second connecting ports where, for example, the internal piston member is adapted to provide a seal on either side thereof. It should be noted that, the amount of pressure through line 170 when, for example, the carriage member is moving downwardly is minimal and does not push down with any degree of force, that would overload the lowering control valve 161. Therefore, the actuating members 160 and 162 operate as a two-stage seal. As is further shown in FIG. 24, the lowering control valve 161 is shown, which has a line portion 165 that interfaces with the hydraulics of the over-snow track vehicle. It should be noted that this lowering control valve is used for safety and to aid in the descent of something that is very heavy to control the rate of descent, as well as other potential operations which are common in the art. Not only can there be a restrictor at the inlet portion near 171 to control the eye downward thrust of fluid in the upper portion of the actuators 160 and 162, but further, a restrictor could be utilized and the actuator 46 can have a flow restrictor placed therein so the forward motion is dampened. In other words, usually these actuators are designed for a snow blade to be attached thereto. By attaching something such as a forklift having a much higher height and hence a greater lever arm, the front-and-back rotation about the lateral axis could be dampened and provide more desirable control over the forklift unit.

It should be noted that the carriage actuator is operated, in one preferred form, from the other opposed winglet actuator, which is inherent in most common over-snow track vehicles. Therefore, for example, the lift actuators 160 and 162 are operated from one winglet hydraulic system, where (for example) hooking the hydraulic system, which is normally used to adjust the winglet in one particular direction, could be used to a raise the carriage member and do the lifting operation of the forklift member. The opposing direction of this particular winglet would lower the whole carriage assembly. Now, with regard to the carriage actuator, the opposing winglets having two hydraulic lines accessible can be utilized to provide any sort of carriage actuation function which could be a side shift, which is common in the art, or possibly a push-pull assembly such as that shown in FIG. 25 to actuate the tine members in the forward and back direction.

It is very common for carriages, which are well-known in the art of forklifts, to have a carriage actuator. In one form, the carriage actuator is a side-shift mechanism which has a type of actuator similar to that as shown in 160 and 162, but generally positioned in the lateral direction to side-shift the entire front carriage, for example left and right. Of course, a plurality of other carriage mechanisms are available, such as that shown in FIG. 25 where a push-pull type carriage is shown where it can be seen that the scissorlike arm members 200 are attached to the fork lift component 202. Of course a variety of attachments that are commercially available can be utilized.

Figure 25:
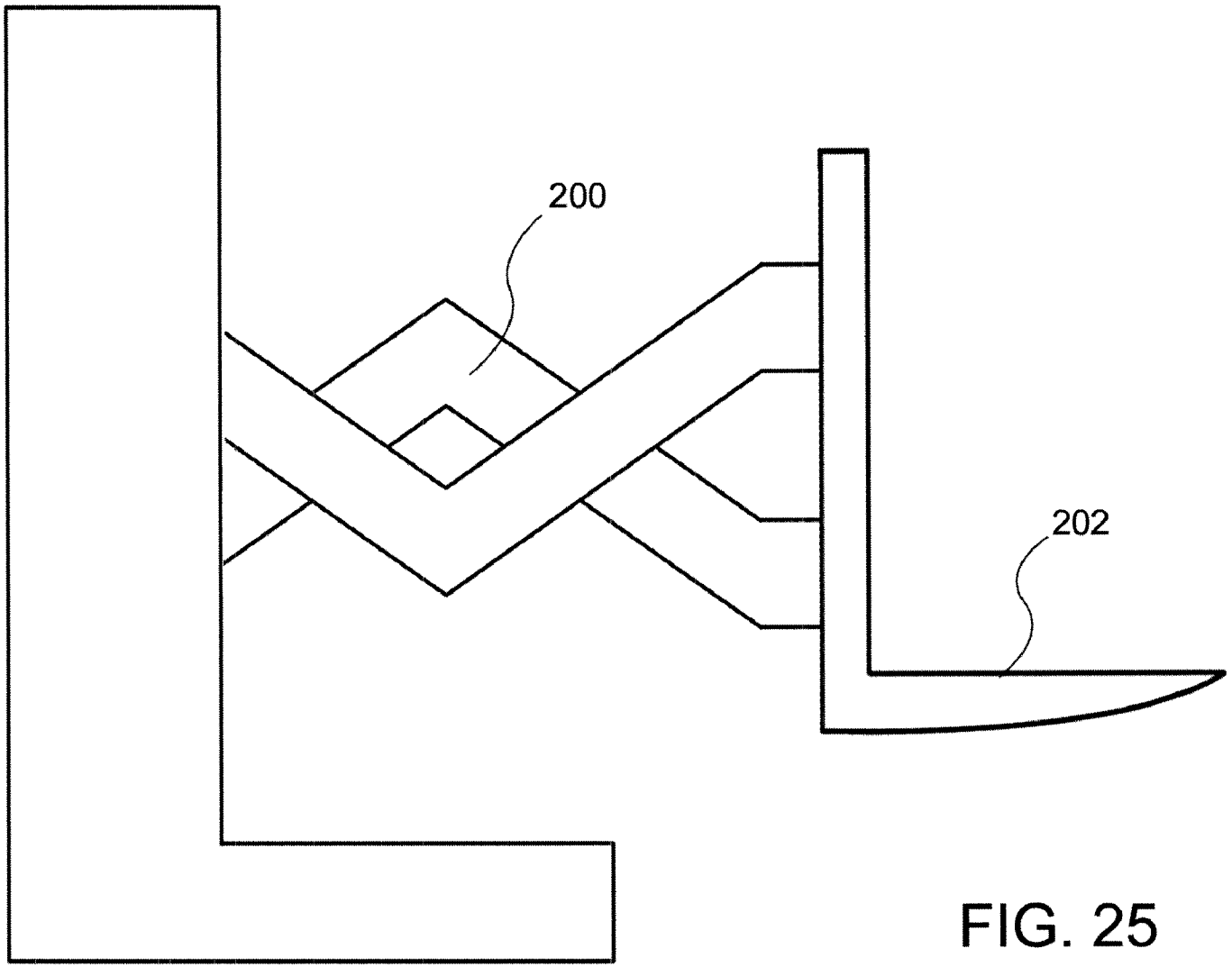
FIG. 25 shows an alternative arrangement for the fork lift assembly as opposed to a side shift mechanism.

In certain over-snow track vehicle configurations, there can be an auxiliary button which may be hooked to an electronic hydraulic control system such that the auxiliary button can operate another set of controls. Either the button itself could operate the electronic hydraulic switches, or the button can be depressed to change the operation of some other previous controls, such as changing the hydraulic switching of a certain action of a joystick. In other words, the auxiliary button would basically change the joystick functions. Therefore, if the carriage in one form has first and second carriage actuators, in one orientation where the auxiliary button is not depressed, a side-shift mechanism can be controlled, and if the auxiliary button is depressed, then in addition to the side shift the push-pull type actuator similar to that shown in FIG. 25 is utilized. Of course, any number of hydraulics can be utilized for the unit interface with existing over snow track vehicle hydraulic members.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept

We claim:

1. A lifting device adapted to be attached to a over-snow track vehicle having a positioning member, a base member, and a control member that is adapted to control a plurality of hydraulic lines, one pair of the hydraulic lines being adapted to operate one or more winglets, the lifting device comprising:

a) an interface member having connection portions adapted to engage the positioning member in a fixedly and removably attached manner, b) a hydraulic lift system having a hydraulic line that is in fluid communication with a hydraulic actuator, the actuator being operatively connected to a repositioning member that is adapted to reposition with respect to the interface member, c) a base mount having an attachment region that is adapted to be rigidly and removably attached to the interface member, d) whereas one of the hydraulic lines that is controlled by the control member which is adapted to control one or more winglets is in communication with the hydraulic actuator.

2. The lifting device as recited in claim 1 where a set of tines are positioned on the repositioning member.

3. The lifting device as recited in claim 1 where the lifting device is operatively configured to be positioned in a stored orientation where standing posts are operatively attached to lateral portions of an intermediate member.

4. The lifting device as recited in claim 3 whereby the storage posts are adapted to be positioned on the intermediate member.

5. The lifting device as recited in claim 4 whereby a second intermediate member can be provided to attach the base mount to a different design of over-snow track vehicle.

6. The lifting device as recited in claim 2 where the actuating system has first and second actuating lines for the actuator which is controlled by first and second hydraulic lines from the over-snow track vehicle designed to control a single winglet.

7. The lifting device as recited in claim 6 where a carriage actuator of the hydraulic lift system is controlled by third and fourth winglet lines of the over-snow track vehicle.

8. The lifting device as recited in claim 7 where the carriage actuator operates a side shift mechanism operatively configured to reposition the tines in a lateral direction.

9. The lifting device as recited in claim 7 where the carriage actuator operates a push-pull assembly operatively configured to reposition the tines in a forward and rearward direction.

10. A method of interfacing a snow fork-lift device with a tracked vehicle, the method comprising:

a) attaching a repositioning member to a base mount in a manner where the repositioning member is adapted to be forcefully moved from a first lower position to a second upper position, b) providing an attachment region of the base mount having a uniform attachment interface, c) attaching a uniform attachment interface to an intermediate member which has a receiving uniform attachment portion and a customized attachment portion where the custom attachment portion is adapted to be retrofitted to the tracked vehicle, d) attaching winglet hydraulic lines to a main actuator that is adapted to forcefully move the repositioning member from the first lower position to the second upper position.

11. The method as recited in claim 10 whereby the actuating system is adapted to reposition the intermediate member to a plurality of orientations.

12. The method as recited in claim 10 whereby stand posts are adapted to be positioned in an operating position to the intermediate member.

13. The method as recited in claim 12 whereby the stand posts are further operatively configured to be positioned in a stored position securely attached to the intermediate member.

14. The method as recited in claim 13 whereby when the stand posts are positioned in the stored position a portion of the stand posts extend laterally from the repositioning member to protect a cab region of a load positioned on tines attached to the repositioning member.

15. A lifting device for an over-snow track vehicle which operates with an over-snow track vehicle having a base mount, the base mount being driven by the over-snow track vehicle actuating system having first and second hydraulic lines, the lifting device comprising:

a) an interface portion comprising a mounting plate having a lifting device mounting region and a base mount attachment region, the base mount attachment region being operatively configured to be fixedly and removably attached to the base mount of the over-snow track vehicle, b) a mast region operatively configured to be fixedly attached to the lifting device mounting region of the mounting plate, c) a carriage, movably attached to a mast region, the carriage being operatively configured to be repositionable with respect to the mounting plate, d) a hydraulic system comprising a drive actuator with first and second inlet ports, the inlet ports being operatively configured to be connected to first and second hydraulic lines of the over-snow track vehicle.

16. The lifting device as recited in claim 15 where the first and second winglet lines of the over-snow track vehicle are controlled by a controller that normally controls a single winglet.

17. The lifting device as recited in claim 15 where third and fourth winglet lines of the over-snow track vehicle are connected to the lift mechanism and control a hydraulic member attached to the carriage.

18. The lifting device as recited in claim 15 where the interface portion is operatively configured to be detached from the base mount of the over-snow track vehicle and be positioned on first and second stand posts.

19. The lifting device as recited in claim 18 where the stand posts are operatively configured to be positioned within mounting receptacles at first and second lateral regions of the interface portion, and the stand posts have a stored orientation where a portion of the stand post extends beyond the first and second lateral portions of the interface member.

20. The lifting device as recited in claim 15 where the interface portion is operatively configured for a particular base mount of the over-snow track vehicle and a second interface member can be replaced to attach the mast region to a different type of over-snow track vehicle.

21. The lifting device as recited in claim 15 where the first and second hydraulic lines are controlled by an operating joystick of the over-snow track vehicle.

22. The lifting device as recited in claim 15 where mast region is welded to the lifting device mounting region of the mounting plate.

23. The lifting device as recited in claim 15 where mast region is fixedly and removabley attached to the lifting device mounting region of the mounting plate.

24. The lifting device as recited in claim 23 where mast region is bolted to the lifting device mounting region of the mounting plate.

* * * * *